US007166037B2

(12) United States Patent
Carter

(10) Patent No.: US 7,166,037 B2
(45) Date of Patent: Jan. 23, 2007

(54) GOLF TRAINING APPARATUS

(76) Inventor: Vandette B. Carter, 5 Granada Crescent, White Plains, NY (US) 10603

( * ) Notice: Subject to any disclaimer, the term of this patent is extended or adjusted under 35 U.S.C. 154(b) by 0 days.

(21) Appl. No.: 10/946,977

(22) Filed: Sep. 22, 2004

(65) Prior Publication Data

US 2005/0064950 A1 Mar. 24, 2005

Related U.S. Application Data

(60) Provisional application No. 60/504,626, filed on Sep. 22, 2003.

(51) Int. Cl.
*A63B 69/36* (2006.01)

(52) U.S. Cl. ..... 473/281; 473/165

(58) Field of Classification Search ..... 473/165, 473/172, 195, 280, 281, 284, 351, 575, 576, 473/579, 580, 586; 273/317, 348, 225; D21/708, D21/709

See application file for complete search history.

(56) References Cited

U.S. PATENT DOCUMENTS

| | | | | |
|---|---|---|---|---|
| 2,116,304 | A * | 5/1938 | Crespin | 473/580 |
| 2,440,473 | A * | 4/1948 | Hughes | 473/395 |
| 3,198,526 | A | 8/1965 | Smith et al. | |
| 4,770,423 | A | 9/1988 | Pinske | |
| 4,776,596 | A | 10/1988 | Nojima | |
| 4,976,431 | A * | 12/1990 | Guenther | 473/417 |
| 5,377,988 | A * | 1/1995 | Westman et al. | 472/281 |
| 5,403,006 | A | 4/1995 | Korte-Jungermann | |
| 5,513,847 | A | 5/1996 | Hu et al. | |
| 5,863,255 | A | 1/1999 | Mack | |
| 5,910,057 | A | 6/1999 | Quimby et al. | |
| D441,414 | S | 5/2001 | Polk, III | |
| 6,231,452 | B1 | 5/2001 | Novosel, Sr. | |
| 6,322,455 | B1 * | 11/2001 | Howey | 473/168 |
| 2003/0148823 | A1 | 8/2003 | Nesbitt et al. | |

FOREIGN PATENT DOCUMENTS

| | | | |
|---|---|---|---|
| GB | 2244933 | A | 12/1991 |
| JP | 1-232980 | A | 9/1989 |
| JP | 1-236074 | A | 9/1989 |

* cited by examiner

*Primary Examiner*—Nini F. Legesse
(74) *Attorney, Agent, or Firm*—David Aker

(57) ABSTRACT

A training golf ball apparatus designed to imitate the realistic feel, weight, acoustic and flight characteristic of a real (regulation standard) golf ball, to allow a golfer to practice the sport in a realistic way safely at home, includes a mechanized shuttlecock; a lightweight ball component and a magnetized tee. When arranged functionally, the device will perform as well as a standard golf ball; give accurate feedback on performance and promote realistic training in the home environment. The device is engineered in such a way to give the illusion that a lightweight golf ball is of standard weight when it is placed on a tee. For safety reason, the training golf ball apparatus changes aerodynamic properties once leaving the golf tee, and behaves as a lightweight, high aerodynamic drag object once airborne.

27 Claims, 7 Drawing Sheets

FIG. 1
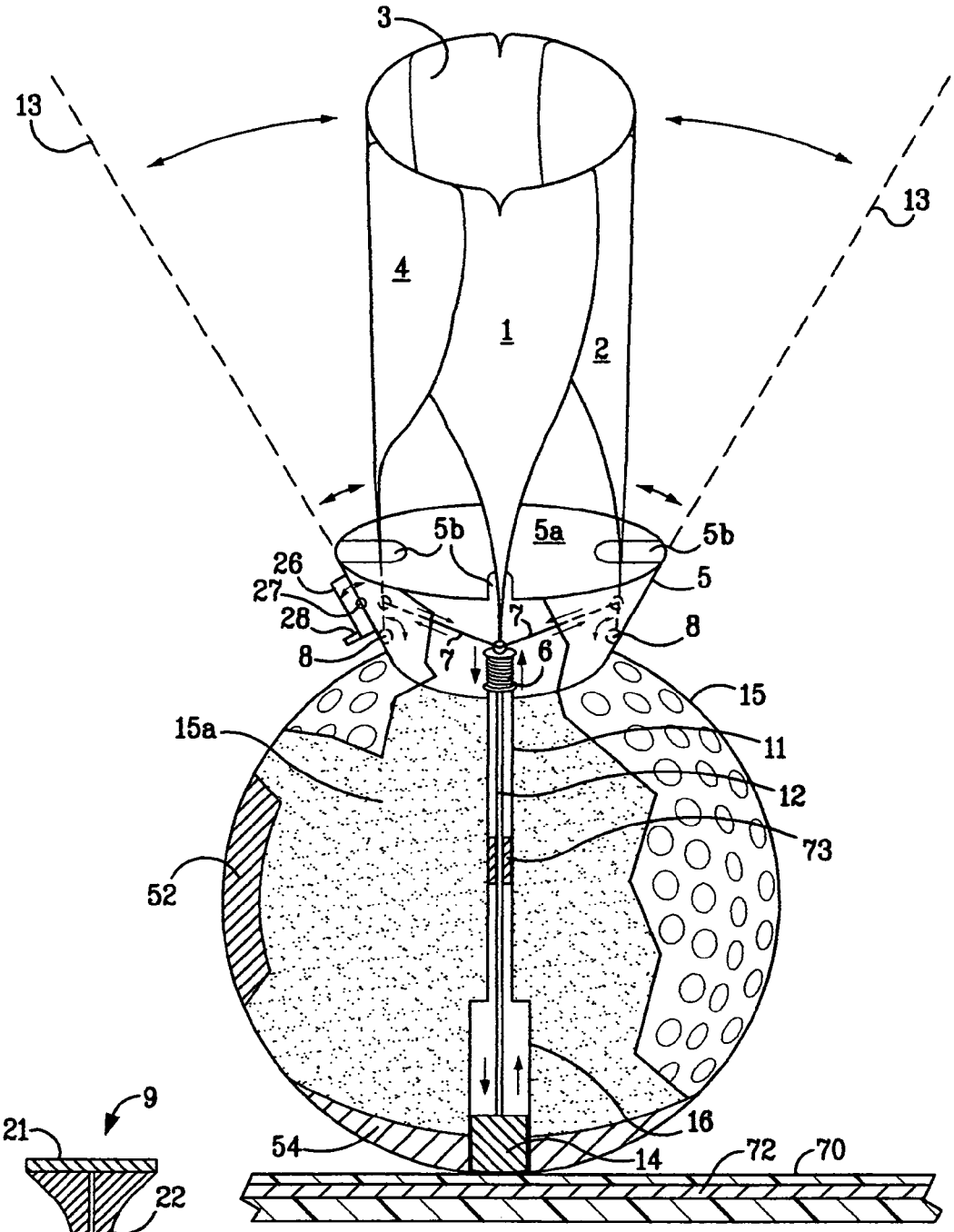
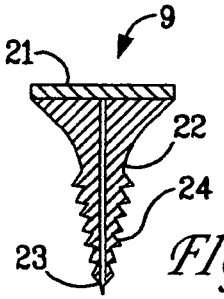
FIG. 1A

FIG. 7
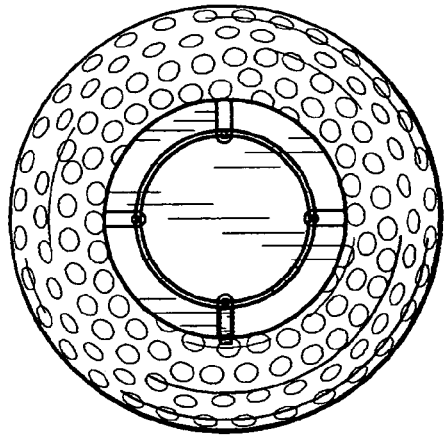
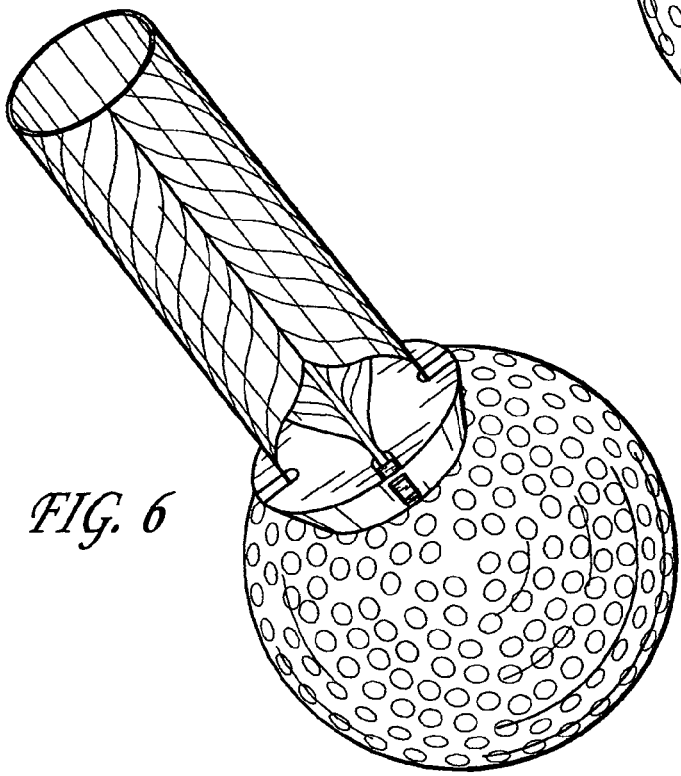
FIG. 6
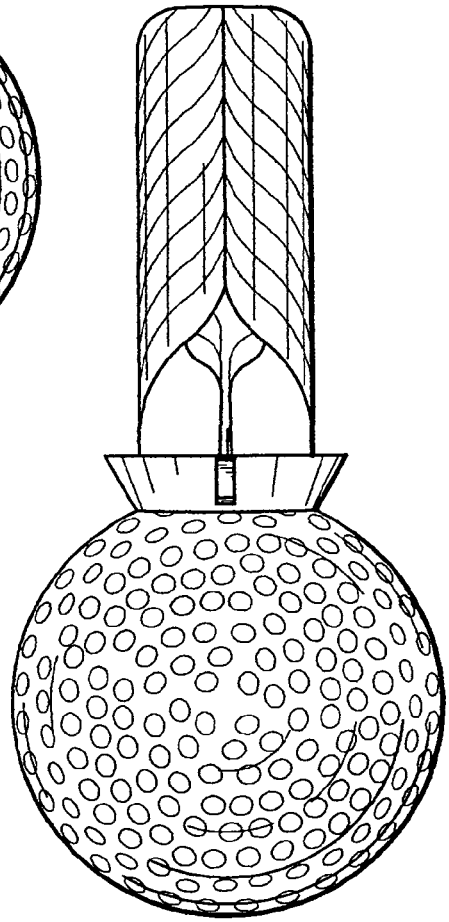
FIG. 8

GOLF TRAINING APPARATUS

This application claims priority under 35 U.S.C. §119(e) from U.S. Provisional Patent Application Ser. No. 60/504,626 filed on Sep. 22, 2003, which is incorporated herein by reference in its entirety.

BACKGROUND OF THE INVENTION

1. Field of the Invention

The present invention relates to apparatus that may be used to simulate certain aspects of the game of golf in a space-restricted environment. More particularly, it relates to those apparatus, for simulating the driving or chipping of a golf ball using a conventional swing of a golf club, without endangering persons or property in a reduce space environment.

2. Prior Art

Generally, there have been a variety of approaches to making games that use projectiles safer. In golf, there are many accomplished models that address the purpose of putting, but to date there is no single device that can simulate with great appreciation the sound, feel and sight of being on a driving range. There are significant dangers and associated short falls of using a standard golf ball in a home setting. Space and safety are often the hindering factors that limit the practice of golf in a home or park environment. What is needed is an invention that utilizes a fraction of the space require for a driving range, but give real time analysis of playing on a course; without compromising the sight, sound, and feel of the sport.

SUMMARY OF THE INVENTION

It is an object of the invention to provide a golf training apparatus for the purpose of practicing pitching, chipping and hitting safely in a home setting.

It is a further object of the invention to provide apparatus that permits a determination to be made as to how far a standard golf ball would travel if hit by a golf club with the same force as used to hit a golf ball training apparatus in accordance with the invention.

It is another object of the invention to provide a golf ball training apparatus which exhibits a non-parabolic flight and with which real time feedback on distance, trajectory and angle of hitting a ball can be experienced.

To address and overcome the effects of gravity, the apparatus uses a magnet to imitate the effect of gravity on a golf ball. The use of magnetic materials replicates the effect of a golf club hitting a standard weight golf ball perched on a tee.

Further, the golf ball training apparatus may have a built in electronic device and compatible unit (not shown in drawings) that will electronically determine the distance the ball has traveled. This can be seen as a LCD display or provided by a voice synthesis system. In other words, when the golf ball training apparatus is hit by a golf club, the distance traveled can be determine by a remote device that will locate the golf ball training apparatus and calculate its distance, angle of flight, etc.

These objects and others are achieved in accordance with the invention with a training golf ball apparatus comprising a generally spherically shaped body; a set of vanes attached to the body so as to be movable between a closed position and open position, the vanes offering greater friction to travel through air in the open position than in the closed position; and a mechanism in the apparatus for maintaining the vanes in the closed position until the ball is traveling through the air.

The training golf ball apparatus may be used in combination with a golf tee, the apparatus and golf tee interacting so that the mechanism maintains the vanes in the closed position. The mechanism may comprise a movable magnet material, and the golf tee may comprise a magnetic material for magnetic interaction with the movable magnetic material. The golf tee may also comprise an electromagnetic for providing at least a portion of a magnet field for magnetic interaction with the movable magnetic material.

The mechanism may comprise a movable body formed of a magnetic material; a linkage between the movable body and the vanes, the vanes, the linkage and the movable body being arranged so that the set of vanes is closed when the movable body is in a first position and the set of vanes is open when the movable body is in a second position; and a biasing component for interaction with one of the linkage, the set of vanes and the movable body so as to bias the movable body toward the second position; the set of vanes being maintained in the closed position by interaction of the moveable body and an external magnetic material positioned externally of the apparatus, the interaction serving to maintain the movable body in the first position as long as the external magnetic material is positioned in proximity to the apparatus.

The training golf ball apparatus may further comprise a pivot for each of the vanes of the set of vanes, for pivotally coupling an end of each of the vanes to the generally spherically shaped body. The linkage may comprise a first rod attached to the movable body; and a second rod attached to each of the vanes at a first end and to the first rod at a second end so that motion of the first rod causes motion of the second rods, so as to move the vanes between the open position and the closed position. The biasing component, which may be a compressed spring, acts upon the first rod.

A pivot may be for each of the vanes of the set of vanes, for pivotally coupling an end of each of the vanes to the generally spherically shaped body. The generally spherical body may comprise a conical extension portion, the pivots being disposed in the conical extension portion. The conical extension portion may b configured so as to limit pivoting motion of the vanes so that the vanes open only to a predetermined angle.

The training golf ball apparatus may further comprise a transmitter disposed in the apparatus. The transmitter may transmit a signal for location of the apparatus. A receiver for the signal may have a facility for determining at least one of: how far the training golf ball apparatus is from the receiver, the trajectory of the training golf ball apparatus, the speed of training golf ball apparatus during flight, and the velocity vector of the training golf ball apparatus during flight.

The training golf ball apparatus may be used in combination with a set of flags, the set of flags having markings for simulated distance of flight of the apparatus.

The training golf ball apparatus may further comprise reinforcing zones associated with the outer periphery of the spherically shaped body.

The training golf ball apparatus may further comprise at least one component including a magnetic material at least partially disposed within the spherically shaped body so as to be able to interact with a magnetic material external to the body, in combination with a training mat. The training mat may have a magnetic material therein, the apparatus and the mat interacting so that the apparatus is attracted to the mat.

The training golf ball apparatus may be used in combination with a golf tee formed of a flexible spring-like material, so that the golf tee is not fractured when the training golf ball apparatus is hit with a golf club.

The training golf ball apparatus may further comprise a mechanism for limiting rate at which the vanes move from the closed position to the open position. The mechanism for limiting the rate may comprise a friction device acting on a moving component of the mechanism for maintaining the vanes in the closed position.

In accordance with another aspect of the invention, a training golf ball apparatus comprises a generally spherically shaped body; and at least one component including a magnetic material at least partially disposed within the spherically shaped body so as to be able to interact with a magnetic material external to the body. This training golf ball apparatus may also be used in combination with a training mat having a magnetic material therein sized, shaped and positioned so that the apparatus and the mat interact in a manner such that the apparatus is attracted to the mat.

This training golf ball apparatus may also be used in combination with a golf tee, the golf tee having a magnetic material, the apparatus and golf tee interacting so that the apparatus is attracted to the tee. The combination may further comprise an electromagnet disposed so as to influence strength of a magnetic field associated with the magnetic material in the tee. The combination may yet further comprise a source of electrical current for the electromagnet; and a control circuit for controlling direction and magnitude of current from the source flowing through the electromagnet.

In accordance with yet another aspect of the invention, a golf training system comprises a training golf ball apparatus having a weight lower than that of a standard golf ball and a device for increasing aerodynamic drag when the apparatus is in flight, and a set of flags, the set of flags having markings for simulated distance of flight of the apparatus.

BRIEF DESCRIPTION OF THE DRAWINGS

The foregoing aspects and other features of the present invention are explained in the following description, taken in connection with the accompanying drawings, wherein:

FIG. 1 is an enlarged, partial perspective, partial cross-sectional view of a training golf ball apparatus or shuttlecock in accordance with the invention.

FIG. 1A is a cross-sectional view of a golf tee in accordance with the invention with which the training golf ball of FIG. 1 may be used.

FIG. 6 is perspective view of the training golf ball apparatus or shuttlecock in accordance with the invention, with the vanes in a closed position.

FIG. 7 is a top view of the training golf ball apparatus in accordance with the invention, with the vanes in a closed position.

FIG. 8 is a side view, with the vanes in a closed position of the training golf ball apparatus in accordance with the invention, with the vanes in a closed position.

DETAILED DESCRIPTION OF THE PREFERRED EMBODIMENTS

Figure 2:
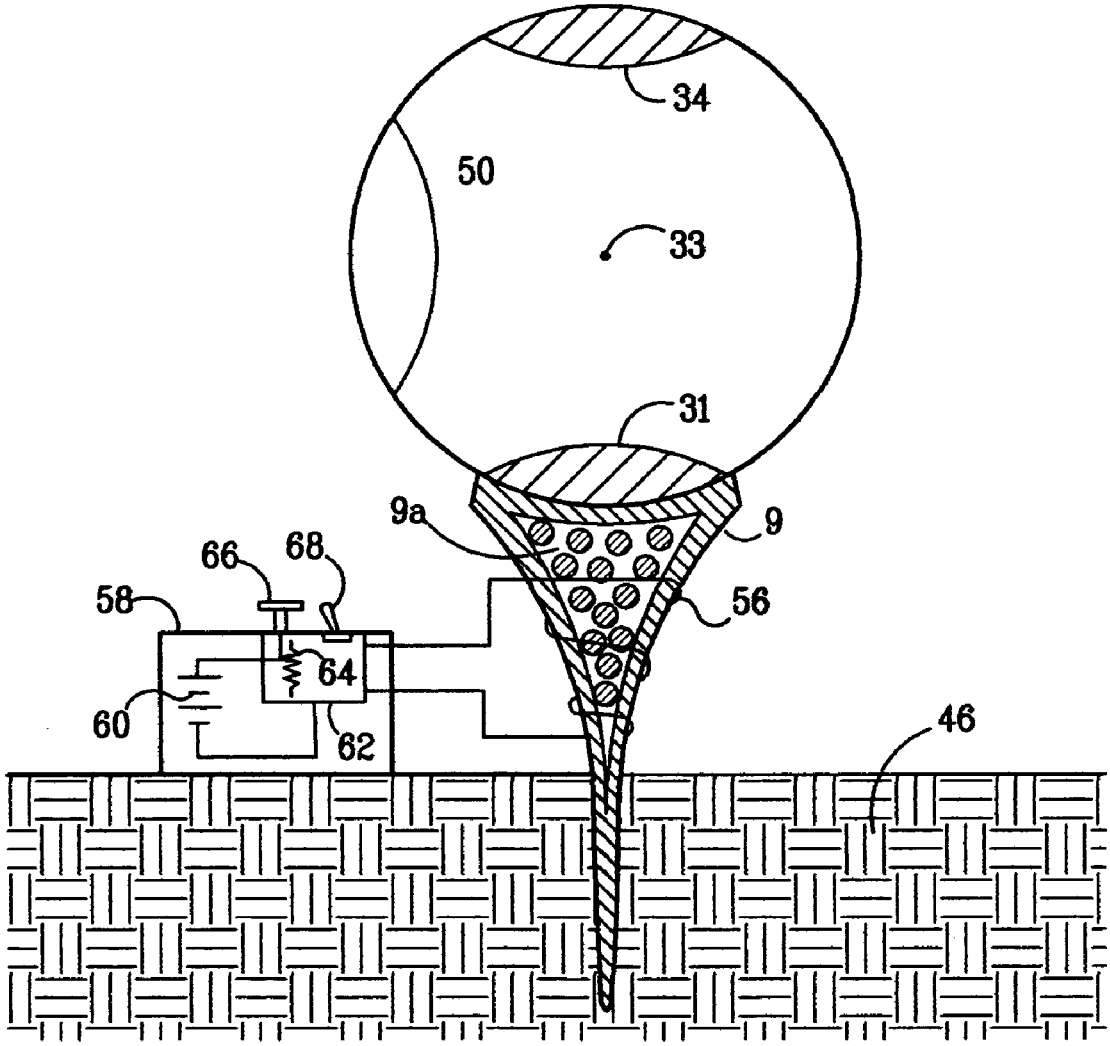
FIG. 2 is a cross-sectional view of a golf ball with modifications permitting it to be used with the golf tee of FIG. 1A.

Referring to FIG. 1, there is shown a cross sectional view of an apparatus incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

In FIG. 1, a shuttlecock or training golf ball apparatus is shown with feather-like entities or vanes 1, 2, 3 and 4 in a closed position, overlapping each other, and configured and possibly colored thereby enhancing esthetic appeal and increasing visibility of a ball or spherical housing 15. In this embodiment four feather-like vanes are shown. These four vanes are each secured by a hinge device or pivot 8, at their bases in a conically shaped housing unit 5. Housing unit 5 has a top 5A, with a respective slots 5B end portions for each of vanes 1, 3, 3 and 4, respectively. The position of each vane 1, 2, 3 and 4 is controller by one of a series of individual rods 7 attached to a spring 6. The feather-like vanes 1, 2, 3 and 4 are designed in such a way that when they expand to full volume capacity, as represented by being deployed to an angle along lines 13 so as to be in a conical or funnel shaped configuration, they will be able to retain a memory to resume a closed orientation as before. Any number of structures having similar features and functions can be used as the vanes 1, 2, 3 and 4, which can be a series of separated vanes, or the vanes may be connected to one another in a manner similar to that of an umbrella. Man-made plastics or fabrics may be used for this purpose.

A single vertical mobile rod 12, is connected at the top of rod 12, to spring 6. Spring 6 has a memory (that is the capability of maintaining its dimensions in both an expanded state, and when compressed with a given amount of force) and makes two functions symbiotically dependent on each other. For example, a cylindrical member 14, formed of a magnetic material, is connected to the other end of rod 12, and is disposed so as to slide in a passageway or chamber 16 in a solid filler material 15A filling most of the interior of the spherical housing 15 of the apparatus. Member 14 is positioned to be physically close to the periphery or circumference of housing 15. When member 14 magnetically interacts with another magnetic material, the vanes 1, 2, 3 and 4 are maintained in the closed configuration illustrated in FIG. 1. In this position, the memory spring 6 is depressed (spirals squeezed together) creating a potential (stored) kinetic energy within the spring 6. The attraction of the magnetic material to a magnetic or magnetically influenced external 'tee' (as described below) or a mat 70 having a thin layer of a magnetic material 72 therein, or a mat having a replaceable magnetic tee, will maintain this stored kinetic energy within the spring. This force will not be released until an external force acts on the ball portion (spherical housing 15) to overcome the attraction between the ball and the magnetic 'tee' (or between the ball and the mat), such as when the ball is struck by a golf club.

By magnetic or by magnetically influenced, it is meant that a material is magnetized, may be magnetized, or is attracted by a magnetic field. When two such materials interact in the present invention, either one will be magnetized so that there is a magnetic force of attraction between them, or if both are magnetized, they will be positioned with respect to one another so as to be attracted to one another, so that, for example, a south magnetic pole of one magnetic faces a north magnetic pole of the other magnet.

By releasing the energy stored within the memory spring by an external applied force, a series of events occur: The magnetic member 14 moves vertically within its chamber 16; causing the vertical rod 12 to also moves vertically within a passageway 11, thus allowing the spring 6 to fully expand, thus releasing its stored energy which will act on the horizontal rods 7, connected to respective vanes just above the hinges 8, resulting in the expansion of the volume occupied by vanes 1, 2, 3 and 4 to the position represented by lines 13.

The spring 6 is returned to its state having potential energy with the aid of a lever 26, mounted on a pivot 27. The top end of lever 26 moves through a slot (not shown) in the side of housing unit 5, when lever 26 is moved by means of a small grip 28, and exerts a force on one of the vanes 4, thus causing the vane 4 to move toward the closed position shown in FIG. 1. Alternately, or in addition, the vanes may be moved to their closed position by gently squeezing the vanes 1, 2, 3 and 4 with the palm of the hand. The action is the reverse of that described above, as the magnetic member 14 returns toward the circumference of the spherical housing 15, and is then placed to be attracted to an external magnetic or magnetically influenced 'tee' or mat, and will remain at this position for as long as the apparatus is not dislodged from the tee.

The training golf ball apparatus may further comprise a mechanism for limiting the rate at which the vanes move from the closed position to the open position. This mechanism may comprise a friction device acting on a moving component of the mechanism for maintaining the vanes in the closed position, such as a cylindrical friction collar 73 having an outer diameter permitting it to be force fit into passageway 11, and a cylindrical opening with a diameter appropriate for exerting a slight frictional force on rod 12 sufficient to slow its motion, but otherwise permitting movement of rod 12.

The outer circumference of the spherical housing 15 may be internally supplemented by thickness-increasing or reinforcing material 52 to enhance the acoustics and strength of the apparatus. A magnetic material 54 can be used to enhance magnetic attraction.

FIG. 1A depicts a magnetized or magnetically influenced tee 9 with a surface area 21 that makes contact with magnetized or magnetic member 14. The tee 9 can be constructed of a flexible or sturdy material that is able to perform the task of supporting the training ball unit of FIG. 1 in a vertical position. For the purpose of chipping practice, a flat surface version (not shown) of this described embodiment can be used to simulate pitching a ball from a level surface. The vertical shaft 22 of the embodiment of the tee 9 has an optional jagged surface 24 for the purpose of securing the device when pushed into the soil. A pointed end or edge 23 facilitates penetration of the end of the tee into the soil 46, which is preferably of a suitable consistency similar to that of an actual playing course.

FIG. 2 is a cross-sectional view of a golf ball apparatus 32 without vanes. Weights 31 and 34 of magnetic influenced or magnetic materials at opposing ends have masses and locations selected to position a center of gravity 33 to be coincident with the center of the ball. The weights 31 and 34 as in FIG. 1, are attracted to a magnetic or magnetized tee 9 with an inner core 9A which may represent a bar magnet within the tee. This particular design is suitable for spaces which are more open than an indoor space and where it is desirable to simulate the effect of hitting a more standard weight golf ball. The magnetic strength can be regulated to achieve a desired effect, i.e., increasing or decreasing the magnetic force between the ball and tee. This unit may also maintain all of the desired benefits as mentioned in respect to the apparatus of FIG. 1 (acoustic, flight characteristics etc).

The apparatus of FIG. 2 may have disposed within, or located on or towards its perimeter, a transmitter 50 (which may also be located at the position of weight 34), for emitting a high frequency signal, which when received by a hand held receiver unit (not shown) can be used to determine the distance that the device has traveled and/or its location. In this regard, reference is made to U.S. Pat. No. 5,910,057, which is incorporated herein by reference in its entirety. The apparatus of FIG. 1, or that of FIG. 3, also may be so equipped. Other parameters, such as speed, velocity vector, trajectory, and force of impact (with a suitable impact sensor, not shown) can be determined in this manner.

Figure 3:
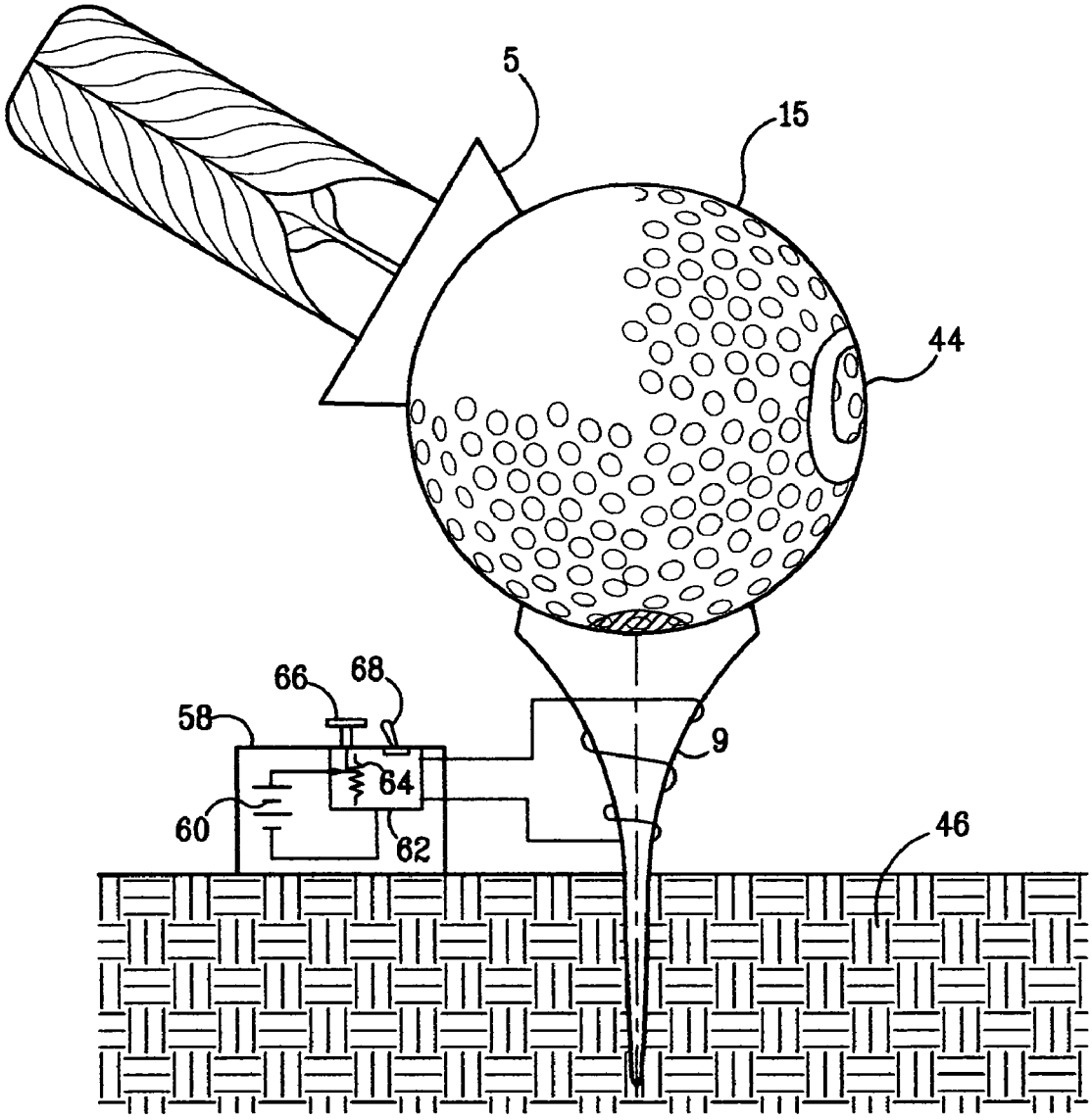
FIG. 3 is a side elevational view of the training golf ball of FIG. 1 mounted on the tee of FIG. 1A, with the vanes closed and the ball ready to be hit by a golf club.

Referring to FIG. 2 and FIG. 3, one of the magnetic materials can be magnetized as a result of an electric current flowing through a wire wrapped around the material, although this may be more appropriate for a tee than for an object that will be hit, and thus must be highly mobile. When the tee 9 is magnetized in this fashion, the strength of the magnetic field may be adjusted by changing the magnitude of a current flowing through a coil 56, thereby controlling the force required to separate the golf ball training apparatus from the tee 5. A control unit 58 having a battery 60 and a current adjusting circuit 62 may be provided for this purpose, so as to adjust both the magnitude and direction of the current. The magnitude of the current may be adjusted with a variable resistor or a rheostat 64 operated with a knob 66. The direction of the current may be changed with a double pole double throw switch 68, having a center off position. The magnetic field generated by the electrical current may work in opposition to or in addition to a magnetic field generated by a permanent magnet within the tee, thus providing a default force of attraction when no current is utilized, and providing the ability to selectively and adjustably reduce or increase the magnetic field strength, and thus the attraction between the golf ball training apparatus and the tee 9. The use of the feature of both a permanent magnet and an electromagnet feature may thus conserve battery life.

FIG. 3 is an external view of the apparatus as described in FIG. 1. The illustration depicts a side profile with the vanes in a closed position facing in the direction of travel of the apparatus when it is hit by a golf club. Area 44 is a zone of impact (the location where a golf club would make contact with the device), that may be an ideal location for a company's logo. The tee 9 is held within soil 46.

Figure 4:
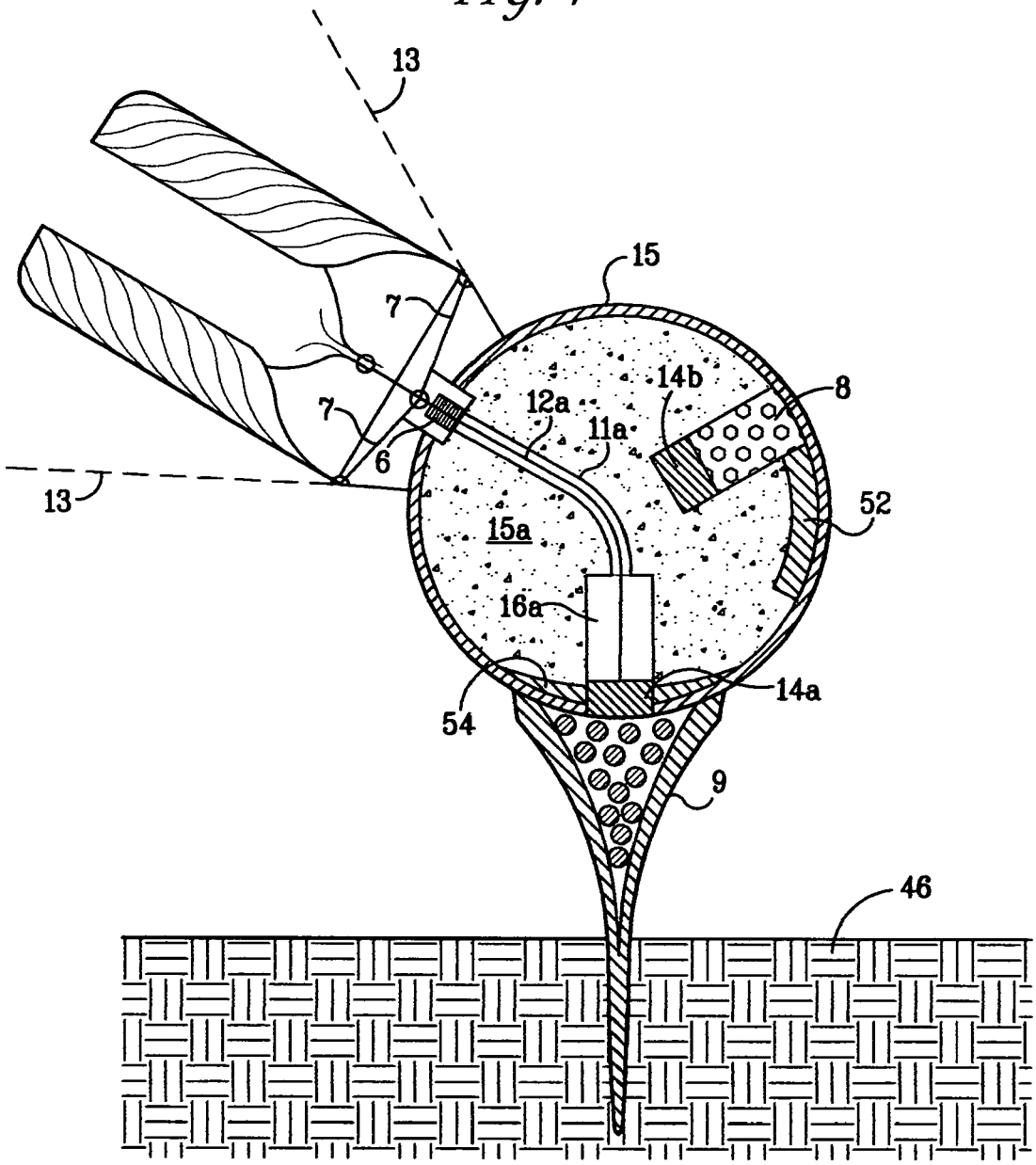
FIG. 4 is a cross-sectional view of the arrangement of FIG. 3, showing further details of the interior of a different embodiment of the training golf ball in accordance with the invention.

FIG. 4 is partially in cross-section to illustrate the internal mechanics of an additional embodiment of the training golf ball apparatus. A flexible rod 12A, disposed in a curved passageway 11A in filler material 15A, is connected to a masher 14A formed of a magnetic material, so as to be attracted to tee 9, and move so as to deploy vanes 1, 2, 3 and 4, as described above with respect to FIG. 1. A fairly centrally disposed non-movable member 14B, which does not need to be made of a magnetic material, and a filler material 8, act as a counter-weight, thus helping to assure stability during flight. As in FIG. 3, the forward facing vanes can also serve as a 'pointer' or aiming accessory that aids in the accuracy of hitting the apparatus in the desired direction. Thus, this embodiment is also shown in the preferred position, having the vanes pointing forward.

The moving magnetic member 14A is housed in chamber 16A with interconnecting rod 12A coupled to one end of spring 6. As in the embodiment of FIG. 1, the outer circumference of the spherical housing 15 may be internally supplemented by thickness-increasing or reinforcing material 52 to enhance the acoustics and strength of the apparatus. A magnetic material 54 can be used to enhance magnetic attraction.

Figure 5:
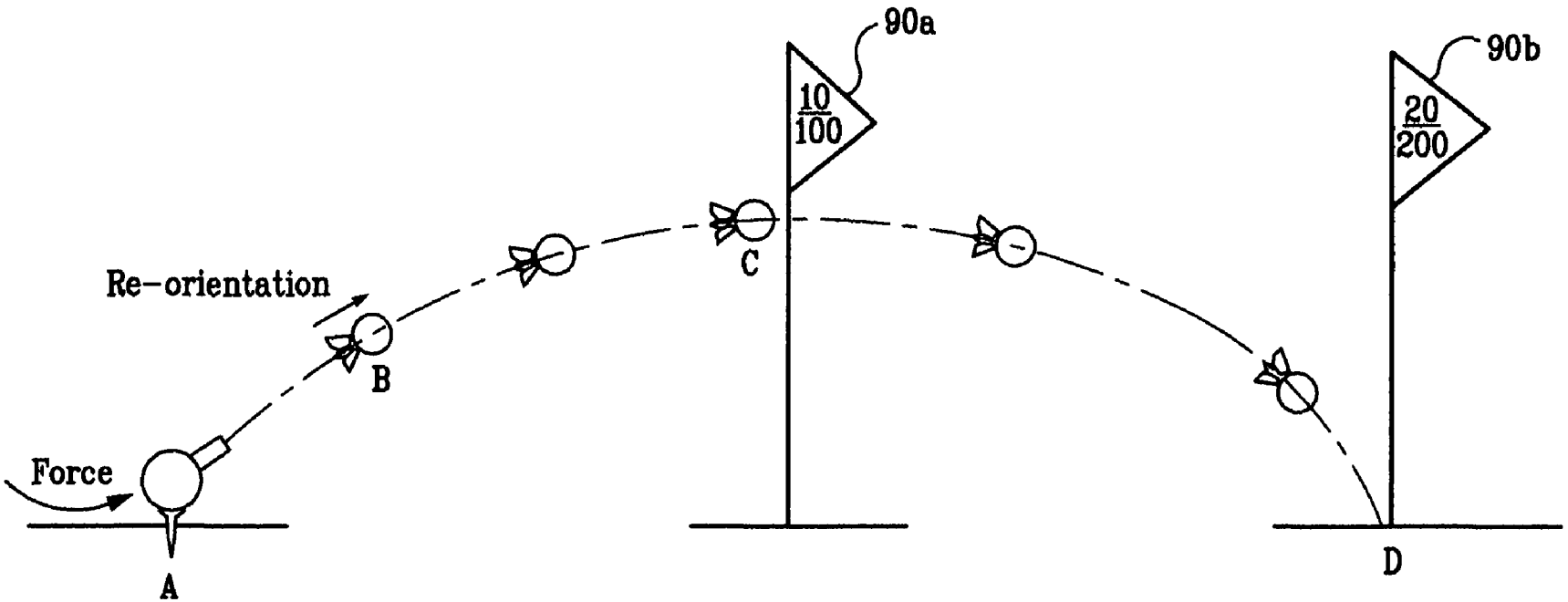
FIG. 5 is a side elevational view illustrating the training golf ball in accordance with the invention being used with a series of distance determining flags to provide an estimate of the distance that a real golf ball would have been driven.

FIG. 5 illustrates a field set-up for the out door arrangement of apparatus in accordance with the invention wherein the initial location of the apparatus is at location A. When the apparatus is subjected to an external force, creating an upward and forward momentum, due to friction or drag as it passes through the air, the device re-orients itself with the ball or spherical housing of the device facing forward along its trajectory, as shown at position B. At positions C and D (as well as possibly at other positions) are one of possibly a series of poled flags 90A and 90B showing a ratio comparison of distance from position A (preferably in yards or meter) between a standard golf ball and the apparatus in accordance with the invention. The numbers on the flags are expressed as a fraction; with the numerator representing the actual distance of travel of the apparatus from position A where the apparatus was hit, and the denominator representing the distance a standard golf ball would have traveled when hit with the same force.

With the calibrated flag system in place, the distance traveled by the training device will give instant feedback on the progress achieved by a particular player, with respect to distance traveled; orientation and trajectory. In other words, a player will be able to inexpensively and conveniently evaluate and perfect his or her game safely and accurately, in a home or small backyard setting. Further, this will be accomplished in an inexpensive, accurate, simple, and error free manner, without the use of any electronic device (such as a transmitter within the training golf ball apparatus, a corresponding receiver and batteries, which may lose the ability to provide energy at an inconvenient time).

In another embodiment of the invention, vanes may be affixed to a spherically shaped body in a permanently open or deployed position, such as illustrated in position B of FIG. 5. The vanes will remain in this position whether the golf ball training apparatus is on the tee, or in flight. A magnetic material may be included in a circumferentially disposed portion of the housing so that the apparatus will magnetically interact with the tee, thus permitting the feel of hitting a golf ball of a higher, normal weight to be simulated.

Figure 9:
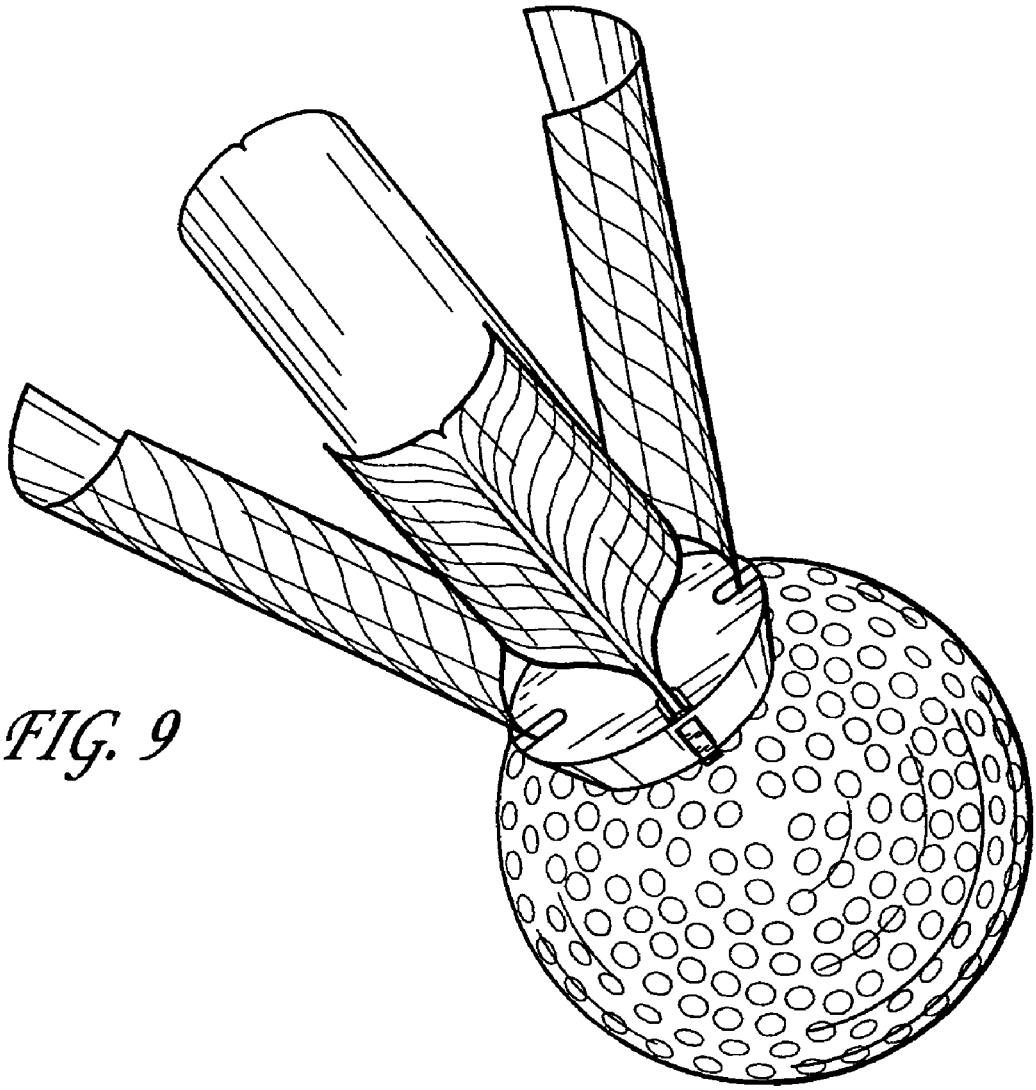
FIG. 9 is perspective view of the training golf ball apparatus in accordance with the invention, with the vanes in an opened position.
Figure 10:
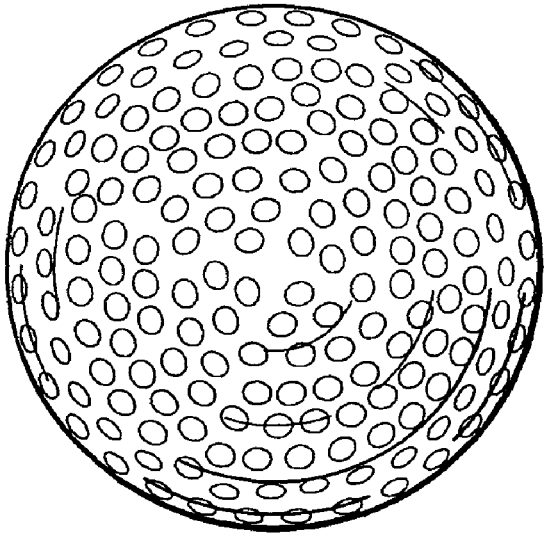
FIG. 10 is a bottom view of the training golf ball apparatus in accordance with the invention.

FIG. 6 through FIG. 10 are provided to illustrate a particular appearance for one embedment of a golf ball training apparatus in accordance with the invention. It will be understood that this particular appearance is merely on of many different appearances that the device may have, while still conforming to the general principles of the invention taught herein. In this regards, FIG. 6 is a perspective view of the training golf ball apparatus or shuttlecock in accordance with the invention, with the vanes in a closed position. FIG. 7 is a top view with the vanes in a closed position. FIG. 8 is a side view, with the vanes in a closed position. FIG. 9 is perspective view with the vanes in an opened position. Finally, FIG. 10 is a bottom view of the training golf ball apparatus in accordance with the invention.

As described with respect to FIG. 1, a tee in accordance with the invention may be constructed so as to resemble a conventional training mat found on a driving range. A planar magnetic material may be embedded is such a mat. Further, a variable height replaceable magnetic tee constructed for use with a training mat eliminates the need for embedding a tee into soil. The tee can be played from an uninterrupted flat surface.

Thus, it will be appreciated that in accordance with the invention, the characteristics of a standard golf ball may be simulated by an apparatus weighing less than the standard golf ball weight of 46.6 grams. This lower weight may be achieved by filler material 15A being of relatively lower density material, or by providing hollow spaces is a somewhat denser material. Regardless of the manner in which such relatively lower weight is achieved, all of the danger and difficulties of using a standard golf ball in a home environment are overcome. A mere fraction of the space generally required to play golf is utilized, while providing the actual sight, sound and feel of the sport. A golfer can eliminate the extra time required to travel to and from a driving range, and the expense of paying for its use, thus in effect saving up to thousands of dollars each year, while at the same time perfecting his or her driving skills in the comfort and convenience of a home environment.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A training golf ball apparatus comprising:

a generally spherically shaped body for placing on a surface;

a set of vanes attached to said body so as to be movable between a closed position and open position, said vanes offering greater friction to travel through air in said open position than in said closed position; and a mechanism in said apparatus for maintaining said vanes in said closed position from when said body is placed on said surface until said ball is struck and dislodged from said surface, whereby said mechanism then causes said vanes to move to said open position.

2. The training golf ball apparatus of claim 1, in combination with a golf tee, the apparatus and golf tee interacting so that said mechanism maintains said vanes in said closed position.

3. The combination of claim 2, wherein said mechanism comprises a movable magnet material, and said golf tee comprises a magnetic material for magnetic interaction with said movable magnetic material.

4. The combination of claim 2, wherein said golf tee comprises an electromagnetic, said electromagnet providing at least a portion of a magnet field for magnetic interaction with said movable magnetic material.

5. The training golf ball of claim 1, wherein said mechanism comprises:

a movable body formed of a magnetic material;

a linkage between said movable body and said vanes, said vanes, said linkage and said movable body being arranged so that said set of vanes is closed when said movable body is in a first position and said set of vanes is open when said movable body is in a second position; and a biasing component for interaction with one of said linkage, said set of vanes and said movable body so as to bias said movable body toward said second position;

said set of vanes being maintained in said closed position by interaction of said moveable body and an external magnetic material positioned externally of said apparatus, said interaction serving to maintain said movable body in said first position as long as said external magnetic material is positioned in proximity to said apparatus.

6. The training golf ball apparatus of claim 5, further comprising a pivot for each of said vanes of said set of vanes, for pivotally coupling an end of each of said vanes to said generally spherically shaped body; wherein said linkage comprises:

a first rod attached to said movable body; and a second rod attached to each of said vanes at a first end and to said first rod at a second end so that motion of said first rod causes motion of said second rods, so as to move said vanes between said open position and said closed position.

7. The training golf ball apparatus of claim 6, wherein said biasing component acts upon said first rod.

8. The training golf ball apparatus of claim 6, wherein said biasing component is a compressed spring.

9. The training golf ball apparatus of claim 5, further comprising a pivot for each of said vanes of said set of vanes, for pivotally coupling an end of each of said vanes to said generally spherically shaped body; wherein said generally spherical body comprises a conical extension portion, said pivots being disposed in said conical extension portion.

10. The training golf ball apparatus of claim 9, wherein said conical extension portion is configured so as to limit pivoting motion of said vanes so that said vanes open only to a predetermined angle.

11. The training golf ball apparatus of claim 1, further comprising a transmitter disposed in said apparatus, said transmitter transmitting a signal for location of said apparatus.

12. The training golf ball apparatus of claim 11, in combination with a receiver for said signal, said receiver having a facility for determining at least one of: how far said training golf ball apparatus is from said receiver, the trajectory of said training golf ball apparatus, the speed of training golf ball apparatus during flight, and the velocity vector of said training golf ball apparatus during flight.

13. The training golf ball apparatus of claim 1, in combination with a set of flags, said set of flags having markings for simulated distance of flight of said apparatus.

14. The training golf ball apparatus of claim 1, further comprising reinforcing zones associated with the outer periphery of said spherically shaped body.

15. The training golf ball apparatus of claim 1, comprising at least one component including a magnetic material at least partially disposed within said spherically shaped body so as to be able to interact with a magnetic material external to said body, in combination with a training mat, said training mat having a magnetic material therein, said apparatus and said mat interacting so that said apparatus is attracted to said mat.

16. The training golf ball apparatus of claim 1, in combination with a golf tee formed of a flexible spring-like material, so that the golf tee is not fractured when the training golf ball apparatus is hit with a golf club.

17. The training golf ball apparatus of claim 1, further comprising a mechanism for limiting rate at which said vanes move from said closed position to said open position.

18. The training golf ball apparatus of claim 17, wherein said mechanism for limiting rate at which said vanes move from said closed position to said open position comprises a friction device acting on a moving component of said mechanism for maintaining said vanes in said closed position.

19. The training golf ball apparatus of claim 1, in combination with:

a set of flags, said set of flags having markings for simulated distance of flight of said apparatus, said markings including a first marking representing actual distance of travel of said training golf ball, and a second marking representing distance a standard golf ball would have traveled when hit with a same force as said training golf ball.

20. The training golf ball apparatus of claim 1, wherein said apparatus for maintaining said vanes in said closed position magnetically interacts with a magnetic material associated with said surface to maintain said vanes in a closed position.

21. A training golf ball apparatus comprising:

a generally spherically shaped body; and at least one component including a magnetic material at least partially disposed within said spherically shaped body and interacting with a magnetic material external to said body to affect the feel of hitting said golf ball.

22. The training golf ball apparatus of claim 21, in combination with a training mat, said training mat having a magnetic material therein, said apparatus and said mat interacting so that said apparatus is attracted to said mat.

23. The training golf ball apparatus of claim 21, in combination with a golf tee, the golf tee having a magnetic material, said apparatus and golf tee interacting so that said apparatus is attracted to said tee.

24. The combination of claim 23, further comprising an electromagnet disposed so as to influence strength of a magnetic field associated with said magnetic material in said tee.

25. The combination of claim 24, further comprising:

a source of electrical current for said electromagnet; and a control circuit for controlling direction and magnitude of current from said source flowing through said electromagnet.

26. The training golf ball apparatus of claim 21, in combination with a golf tee formed of a flexible spring like material, so that the golf tee is not fractured when the training golf ball apparatus is hit with a golf club.

27. A training golf ball apparatus in combination with a golf tee, comprising:

a generally spherically shaped body;

a set of vanes attached to said body so as to be movable between a closed position and open position, said vanes offering greater friction to travel through air in said open position than in said closed position; and a mechanism in said apparatus for maintaining said vanes in said closed position until said ball is traveling through the air;

the apparatus and the golf tee interacting so that said mechanism maintains said vanes in said closed position, said mechanism causing said vanes to move to said open position when said apparatus is removed from said tee.

* * * * *